US006149099A

United States Patent [19]

Meinecke et al.

[11] Patent Number: 6,149,099

[45] Date of Patent: Nov. 21, 2000

[54] WINDING DEVICE FOR THE WINDING-UP OF A PAPER WEB

[75] Inventors: Albrecht Meinecke; Hans-Joachim Fissmann, both of Heidenheim, Germany

[73] Assignee: Voith Sulzer Papiermaschinen GmbH, Germany

[21] Appl. No.: 09/343,284

[22] Filed: Jun. 30, 1999

Related U.S. Application Data

[62] Division of application No. 08/952,598, filed as application No. PCT/EP96/02224, Nov. 21, 1997, Pat. No. 5,954,291.

[30] Foreign Application Priority Data

May 24, 1995 [DE] Germany ..... 195 19 012

[51] Int. Cl.[7] ..... B65H 18/16; B65H 18/20; B65H 19/30

[52] U.S. Cl. ..... 242/530.4; 242/533.3; 242/541.1; 242/541.5; 242/542; 242/542.3

[58] Field of Search ..... 242/530, 530.1, 242/530.4, 541.1, 541.5, 541.6, 541.7, 542.3, 542, 533.3

[56] References Cited

U.S. PATENT DOCUMENTS

| | | | |
|---|---|---|---|
| 1,951,182 | 3/1934 | Bessmer et al. . | |
| 2,984,426 | 5/1961 | Johnson . | |
| 2,989,262 | 6/1961 | Hornbostel . | |
| 3,202,374 | 8/1965 | Phelps | 242/541.1 |
| 3,841,578 | 10/1974 | Dorfel . | |
| 4,191,341 | 3/1980 | Looser . | |
| 4,415,128 | 11/1983 | Heymanns | 242/541.6 |
| 4,508,283 | 4/1985 | Beisswanger . | |
| 4,552,316 | 11/1985 | Dropczynski et al. | 242/533.3 |
| 4,697,755 | 10/1987 | Kataoka . | |
| 4,893,762 | 1/1990 | Schonmeier | 242/541.6 |
| 4,932,599 | 6/1990 | Doerfel | 242/541.6 |
| 5,054,707 | 10/1991 | Olson . | |
| 5,518,199 | 5/1996 | Welp et al. | 242/541.6 |
| 5,520,354 | 5/1996 | Adamski | 242/541.1 |
| 5,611,500 | 3/1997 | Smith | 242/542.3 |
| 5,664,737 | 9/1997 | Johnson et al. | 242/541.1 |
| 5,690,298 | 11/1997 | Ruck | 242/542.3 |

FOREIGN PATENT DOCUMENTS

| | | |
|---|---|---|
| 1091856 | 10/1960 | Germany . |
| 2365606 | 9/1975 | Germany . |
| 2431691 | 1/1976 | Germany . |
| 2506235 | 9/1976 | Germany . |
| 2751829 | 5/1979 | Germany . |
| 3013652 | 10/1981 | Germany . |
| 9202919 | 6/1992 | Germany . |
| 58-139947 | 8/1983 | Japan . |
| 1502062 | 2/1978 | United Kingdom . |
| 2085413 | 4/1982 | United Kingdom . |
| 2131773 | 6/1984 | United Kingdom . |

*Primary Examiner*—John M. Jillions
*Attorney, Agent, or Firm*—George Pappas

[57] ABSTRACT

The invention concerns a winding device for taking up a paper web immediately after manufacture. The device comprises a carrier drum onto which the paper web is guided from one side (feed side); a winding rod with bearing journals; articulated levers which support the bearing journals in brackets and cause the winding rod with the rolled paper web to pivot around the carrier drum from a feed position into a pay-out position; a longitudinal cutter in the region of the winding-on side and upstream of the carrier drum for cutting the web into strips; a pressure roller for exerting contact pressure on the paper strips; and a support roller on the run-off side of the carrier drum in the pay-out region.

11 Claims, 4 Drawing Sheets

WINDING DEVICE FOR THE WINDING-UP OF A PAPER WEB

CROSS REFERENCE TO RELATED APPLICATIONS

This application is a division of Ser. No. 08/952,598 filed Nov. 21, 1997 now U.S. Pat. No. 5,954,291, which is a 371 of PCT/EP96/02224, filed May 23, 1996.

TECHNICAL FIELD

Background of the Invention

The invention relates to a device for the winding-up of a paper web.

Such winding devices have become known under the name of Pope rollers. Herewith the paper web emerging from the paper machine at a high velocity is wound up into a roll. The roll has the width of the paper web, and a correspondingly high weight (so-called jumbo roll).

The roll is then transferred from the Pope roller by crane into the winding-out of the roll-cutting machine. The roll-cutting machine serves primarily to subdivide the very wide paper web into several narrower webs and to rewind them, in which process in the then arising narrower rollers there is generated a certain, mostly as high as possible, winding hardness. Such a machine has accordingly a plurality of cutting apparatuses, mostly circular knife pairs, the circular knives of which are arranged on both sides of the paper web and cooperate with one another in the manner of shears. Furthermore, for the generation of the winding hardness mentioned a loading roller is provided.

By reason of the great weight of the jumbo rolls, in the winding on the carrying drum of the Pope roller, and in the transport from the Pope roller to the roll-cutting machine there occur certain overloadings of certain layer zones, especially of the borders and of the inner layers. This leads to winding faults in the roll-cutting machine, especially in the edge rolls leading the roll-cutting machine. Hereby there results costly waste.

BRIEF SUMMARY OF THE INVENTION

Underlying the invention is the problem of improving the winding process and the cutting process. Thus, the mechanical and the labor expenditures are to be reduced. Furthermore, over-turnings and crease formations in the rolls are to be avoided.

In order to achieve this, the inventors propose a new way. This consists essentially in combining the Pope roller of the paper machine with the roll-cutting machine in construction.

The invention is explained with the aid of the drawings.

DETAILED DESCRIPTION OF THE PREFERRED EMBODIMENTS

Figure 1:
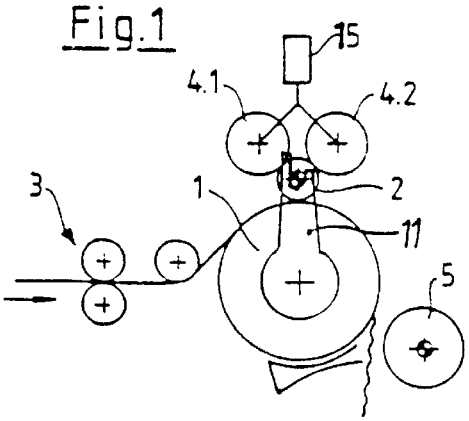
FIGS. 1–6 illustrate a first concept of the invention which shows a winding machine in various stages of operation using a carrying drum and paired rider rollers.

FIGS. 1 to 6 illustrate a first concept of the invention, called "concept 1" in the following.

One perceives the basic elements of a winding machine with the elements according to the invention. The winding machine is engaged directly on the outlet side of a paper machine (not represented here). It can also be a constructive component of the paper production machine and have, for example, the same support.

The winding device according to concept 1 comprises a carrying drum 1, onto which the paper web is brought on one side, the so-called infeed side. The paper machine would therefore be located to the left of the winding device in the drawing.

To the carrying drum there is assigned a winding core 2, for example a tambour, onto which the paper web is directly wound. The winding core 2 has two pivot pins. These pivot pins, which are not represented in detail here, are received in a manner known per se by forks of toggle joints 11. A toggle joint is borne on each face side of the carrying drum, and, namely, in the zone of its axis. The toggle joints 11 serve therefore to carry the winding core 2 and—together with at least one paper roll wound on the winding core 2 in the course of its arising—to swing it around the carrying drum 1 until a delivery position is reached. The same holds when the winding core 2 is a winding rod; this is equipped with a plurality of winding sleeves, and namely in each case corresponding to the desired width of the roll to be generated.

On the infeed side there is present a longitudinal cutter 3 for the cutting-up of the paper web into several strips of the width desired for the paper rolls to be generated. In the case of a relatively narrow paper-production machine, the longitudinal cutter, if so desired, serves only for the separating-off of border strips, so that only a single paper roll is wound up. In this case there can be provided only one tube as winding core, which is guided on its two ends by means of guide heads.

Further there are provided two load rollers, so-called rider rollers 4.1, 4.2, which provide inter alia for the smooth running of the winding core 2 with paper roll rolled onto it. The two rider rollers 4.1 and 4.2 are suspended on a common device 15 and are pressable by this against the paper roll. There a hydraulic or a pneumatic system as well as a regulating mechanical system are provided for the dosing or controlling of the contact pressure force in order to generate the required winding hardness. Instead of the two load rollers 4.1, 4.2 there can also be provided only a single load roller.

There is perceived further in the delivery zone a carrying roller 5. Onto this the paper roll is lowered at an advanced state of the winding process. In the zone of the carrying roller 5 there can be provided a discharge table 6. This is swingable, so that with a roll not yet finished it can perform a protective function, but with a finished roll it exerts a lowering and transport function.

Figure 6:
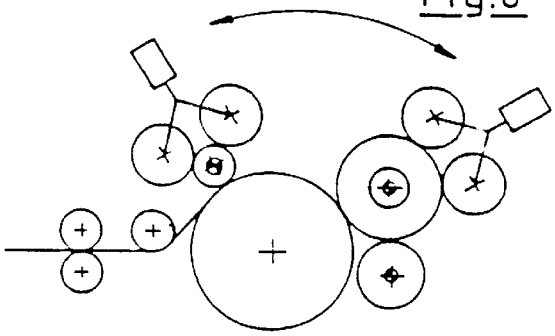

Instead of the one rider roller pair 4.1, 4.2 with suspension and pressing function, there can also be provided two such devices—see FIG. 6.

The device according to FIG. 1 operates as follows:

First of all the paper web which is brought on in arrow direction from the left in the drawing, is led through the cutting arrangement 3 and, namely, at first without winding on. It runs accordingly first around a large part of the circumference of the carrying drum 1 and then falls downward between carrying drum 1 and carrying roller 5 into a discard pulper. For the sure guiding of the web the carrying drum 1 can be constructed as a suction roller.

Now the winding core 2 is set into rotation, preferably by means of a center drive, and brought to the same circumferential velocity as the carrying drum 1. Thereupon it is emplaced on the carrying drum 1. The paper web is now wound onto the winding core. Here there are various possibilities for the severing of the web (transversely to the running direction) and for fastening the new web beginning to the winding core, for example to the tubes. These methods are known and therefore do not need to be further specified.

The longitudinal cutter 3 is then activated as rapidly as possible, so that the arriving web is cut up into the desired number of paper strips.

Figure 2:
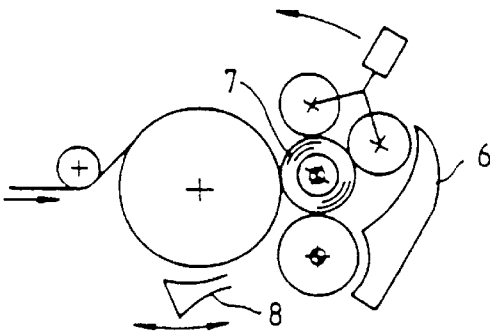
Figure 3:
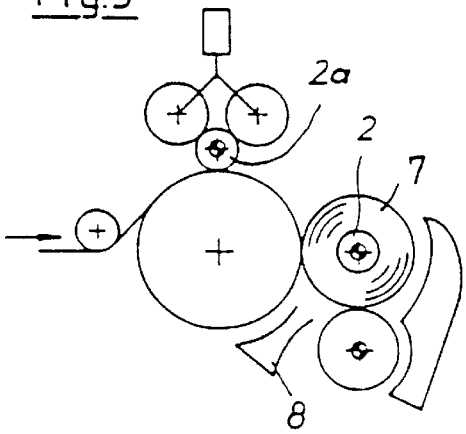

After the passing of a certain time span the packet, which consists of the winding core 2 (possibly with center drive) with the wound-on paper rolls as well as of the load rollers 4.1, 4.2 and the suspension and pressing device 15, is swung clockwise until the paper roll 7 lies on the carrying roller 5 (FIG. 2). When the roll weight is great enough so that a pressing-on by the rider rollers 4.1 and 4.2 is no longer desired, then these together with the device 15 are again swung back into the starting position (FIG. 3). At this point of time the winding core 2 continues to be driven by a center drive. If necessary, two of these drives can be allocated to the winding core 2, and namely a drive at each face-side end of the winding core 2. In this case the mentioned swinging-back of the rider rollers 4.1, 4.2 is carried out together with a first one of these two center drives. In another variant, to a first winding core 2 there is assigned only a single, for example drive-side, center drive, in which case the following winding core 2*a* is coupled to a driver-side center drive and the following winding core is again coupled to the drive-side center drive, etc.

When the packet mentioned (4.1, 4.2, 15) is again located in the waiting position—see FIG. 3—, then from the side, for example, a new winding rod is driven in with tubes present thereon. Alternatively to this—before the swinging back of the packet mentioned—a new winding core 2*a* for example, can be brought from above into the waiting position. At the given time point—at the change of rolls after tearing-off of the paper web—the following paper web can again be wound on.

Figure 4:
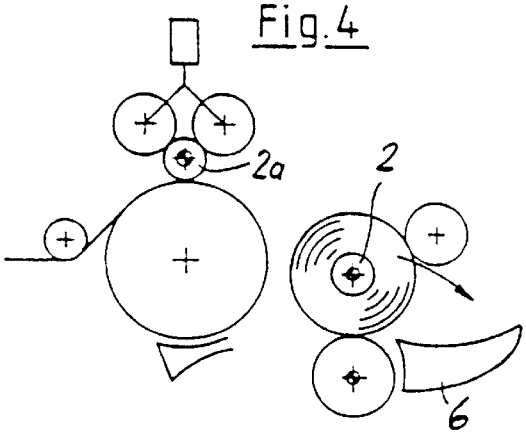
Figure 5:
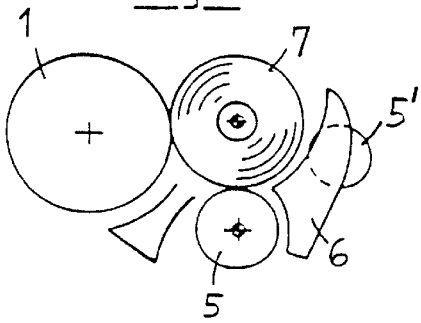

When according to FIGS. 3 and 4 the desired roll diameter is achieved, then the web is severed in transverse direction, and there occurs—as mentioned—a new winding onto the empty winding core 2*a*. Simultaneously the generated rolls 7 are at a slight distance from the mantle surface of the carrying drum 1, until braked to the turning rate 0 and ejected. Obviously, besides the carrying roller 5 and the discharge table 6, further supporting rollers are possible; for example according to FIG. 5 a supporting roller 5' can be integrated into the discharge table 6.

It is also thinkable to reduce the contact pressure force resulting from the weight of the paper rolls between the paper rolls 7, on the one hand, and the carrying drum 1 as well as of the carrying roller 5 on the other hand by a compressed air arrangement 8. This conveys compressed air from underneath against the paper rolls 7.

Obviously the geometric relations can be altered according to need.

If an individual, cut paper web should tear between the longitudinal cutter 3 and the roll-up place, and the cut paper web concerned (paper strip) should run without problem into the waste paper pulper, then a computer decides whether a new rolling-up started, or whether the running rolls are wound to completion, in order to minimize the waste.

The carrying drum 1 can be perforated, grooved, (or) sucked. The mantle surface of the carrying drum 1 can be metal-sprayed, or, for example, have a plastic coating.

Further variants:

The turning winding core 2 can be emplaced on the carrying drum either, as represented in FIG. 1, in the 12 o'clock or 0 o'clock position or in any intermediate position from the 9 o'clock to the 3 o'clock position (horizontal). In winding-on in a position which deviates from that of 3 o'clock, it (winding core) can at any time be swung into the later winding position, preferably into the 3 o'clock position. For the winding cores a device can be provided for their storage (magazine). as well as an accelerating device with drive and an installing direction (vertical guidance, for example with rails or slide pieces).

If the winding-up takes place (similar to FIG. 14) approximately in the 3 o-clock position, the required winding hardness is preferably generated by the means that between the paper roll or rolls 7 and the carrying drum 1 a certain linear force is set in, for example by means of a regulating arrangement 14 for the contact pressure force. For this either the winding core 2 or the carrying drum 1 or both are horizontally drivable.

When the final diameter of the paper roll(s) is reached, the nearly full winding core 2*b* can be transferred for the roll change, away from the carrying drum 1 briefly into a free-winding position, in order to provide space for the installing of a new winding core. There the drive of the winding core 2*b* occurs in free-winding operation over the center drive. In order, in the free-winding operation, to prevent the drawing of air into the paper roll, for example, the roller 5*a* represented in FIG. 14 can serve as squeeze-out roller, which then remains lying against the large roll 7' and travels along the entire adjusting path. This roller 5*a* can be pressed on pneumatically or hydraulically or for example as brush roller be applied only for contact. The surface of the squeeze-out roller 5*a* can be constructed rubberized smooth or grooved, as a brush, with porous and soft coatings, with inflatable tube, as flexible profile roller or the like.

Figure 14:
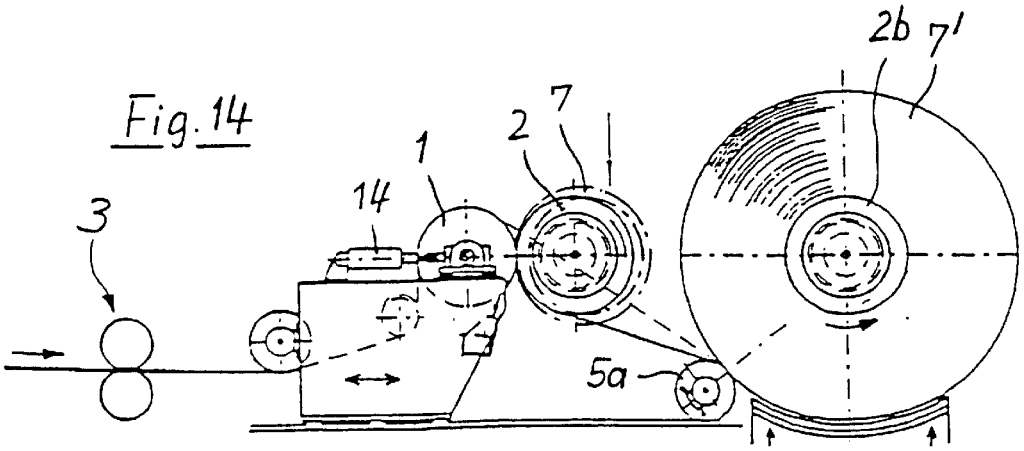

The horizontal movement of the larger roll(s) in the free-winding operation can be realized on rails or slide pieces. Instead of the driving-away of the large roll(s) shortly before the final diameter is achieved, there is also thinkable a driving-away of the carrying drum 1 (or of a pressure controlled contact roller) for the achievement of a "changing gap" (FIG. 14).

In the roll change the transverse severing of the web can take place with briefly inactivated longitudinal cutters 3 or simultaneously on the longitudinally cut individual webs. The drive becoming free in each case is driven back into the winding-on position for a new empty winding core or into an interlying drive-change position.

For unburdening the weight of the arising paper rolls there are the following possibilities:

- the winding-on position of the rolls is fixed (for example 3 o'clock position). A weight unburdening occurs by means of compressed air, band guides and the like from underneath. The free-winding operation for the roll change occurs by moving-away of the carrying drum 1 or contact pressure roller,
- or the weight unburdening unit is carried along in the moving-off of the rolls (roll) or of the drum,
- or the winding core, from a certain roll weight onward, is driven with the carrying drum into a weight unburdening position and finished there with activated weight unburdening.

Concept II is represented in FIGS. 7 to 10.

The winding device shown can again be engaged directly on the outlet side of a paper machine or even be an integral constructive component of a paper machine. Here, too, again a longitudinal cutter 3 is provided which cuts the paper web coming from the paper machine into a number of strips.

Figure 7:
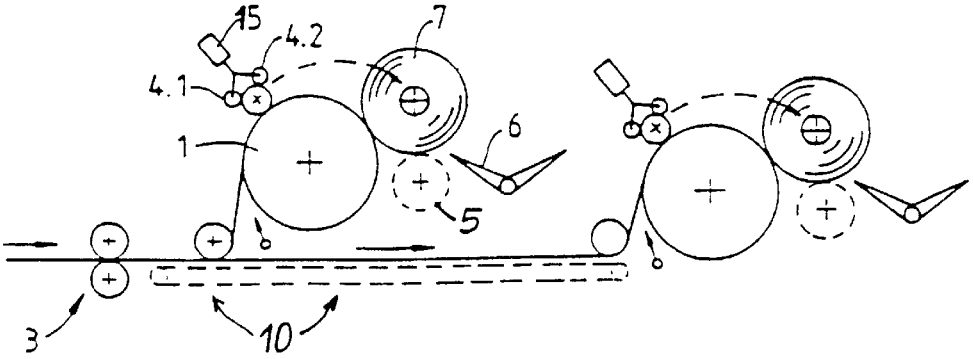
FIGS. 7–10 illustrate a second concept of the invention wherein at least two winding stations are used.
Figure 8:
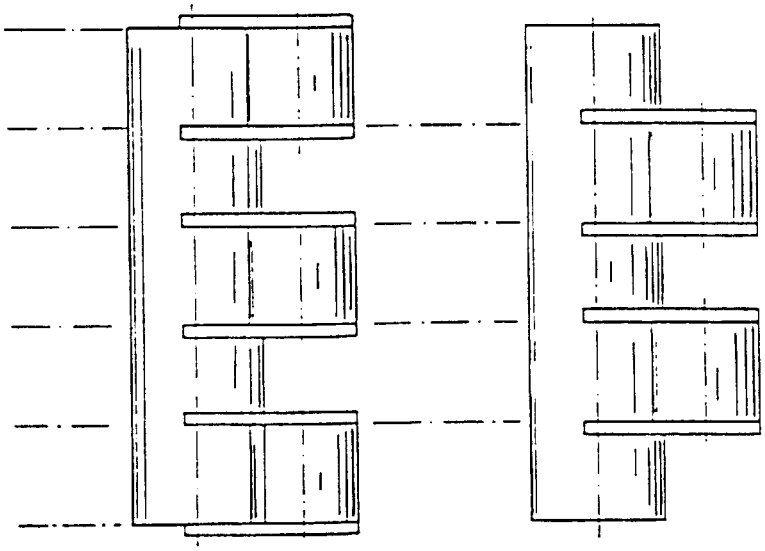

The special feature of concept II—see FIGS. 7 and 8—lies in that at least two winding stations are provided. The feed to the individual strips cut out of the broad paper web occurs in alternation over a corresponding web transfer system 10. There can also be several winding stations provided.

Each winding station essentially comprises the same elements. In the following there is to be treated in detail only the first winding station (represented on the left). There is perceived again a carrying drum 1. The arising paper rolls are guided on both sides by means of tension heads, but without drum, and driven by means of a center drive. Here, too, rider rollers are again provided—in the present case again two rollers, 4.1, 4.2—with appertaining guide and press-on device 15.

Also carrying drum 1 has a drive of its own. Its mantle surface can again be grooved, spirally slotted, metal coated or smooth. If the mantle of carrying drum 1 is bored, then a suction treatment is possible.

For the feeding of the paper strips to the carrying drums 1 there serve air-guide plates, conveyer bands, blowing tubes or the like.

The individual paper strips that are cut out of the wide paper web leaving the paper machine are transferred "alternatingly" to the winding station concerned, and namely in such manner that in each case strips adjacent to one another are fed to different winding stations. From this there is yielded—as seen in plan view—a picture as is presented in FIG. 8.

The guidance of the tension heads with the gripped paper rolls occurs by means of pneumatically or hydraulically controlled cylinders. Each tension head pair has an axial adjusting arrangement, which brings about a tightening or loosening.

Figure 9:
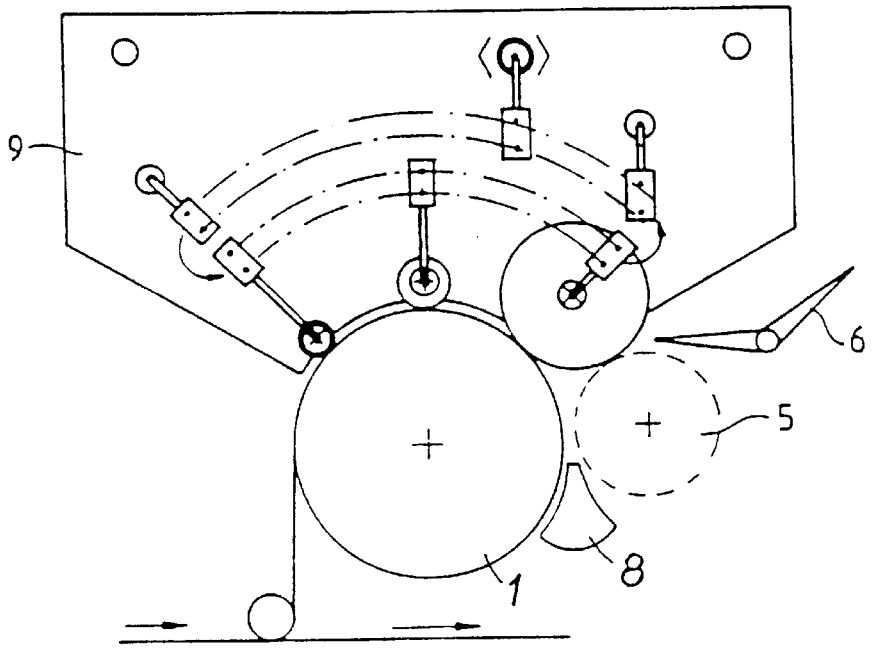
Figure 10:
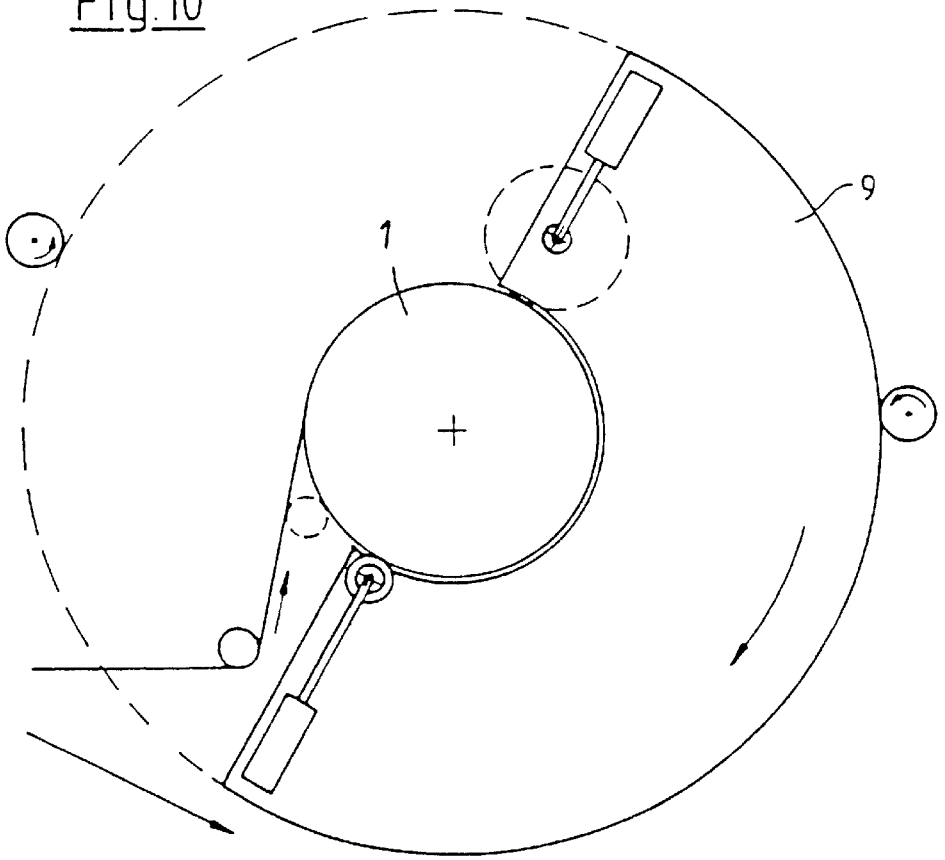

For the reception of the control cylinders as well as for their guidance there are provided side shields 9 for each roll side—see FIGS. 9 and 10. The side shields 9 generally are arranged in guides adjustable in correspondence to the format transversely to the paper running direction. The guides serve also for the reception of the device 15 (rider roller cylinder).

At each end of the arising paper roll there can be provided a single cylinder, but also several such cylinders.

The ejection of the finished rolls occurs in a usual manner. For this there can serve a carrying roller 5, further a lowering table 6 and possibly further rolls.

The tube feed occurs in the cylinder return run. A central computer provides the control.

The apparatus operates as follows: The paper web arriving from a dry part of a paper machine or from a smoothing mechanism passes first through the longitudinal cutter 3. On the winding rods there are present tubes which are prepared for the so-called splice and are brought by the center drive of the rod to operating speed.

In the emplacing of the winding tubes the appertaining web strip is gripped and wound. This occurs in the primary position represented in FIG. 7 (left station).

The rider rollers 4.1 and 4.2 are engaged; they stabilize the running and determine the winding hardness already at the beginning of the winding process.

The further winding occurs in the secondary position—see the position of the paper roll 7 represented in FIG. 7. At this time point a free tension head pair is brought back into high speed over an automatic tube loader (not shown here) into the primary position and stands in waiting position for the renewed use, for example when the rolls are finished or in the case of a tearing-off.

When the rolls 7 are finished and are present in the secondary position shown in FIG. 7, then the rolls are braked and transferred to the discharge table 6, from where they are discharged. The tension heads with control cylinder are equipped in the tube loader with new tubes. The tubes present in the waiting position (primary position) now come into use.

If a paper strip should tear, then one proceeds as in concept I.

Concept II has the advantage that always reproducible rolling-up conditions prevail, so that the two-sidedness of the rolls is avoided. Very large and heavy rolls can be unburdened supported by an additional carrying roller in the secondary position or by a compressed air arrangement. Obviously a circumferential-difference control is possible.

During the format change the paper web is conducted in its full width before the longitudinal cutter into a waste pulper (not represented here).

An advantage of the concept lies also in that an individual winding hardness control is possible at the individual winding stations. Rolls of different diameter size can be wound simultaneously. Also the use of cardboard tubes as well as of steel tubes simultaneously is possible.

The pressure rollers (4.1, 4.2) are in use only in the winding-on. FIG. 10 illustrates a winder with swinging part for the change of tubes and rolls for each side of the paper strips to be wound alternatingly.

A returning of the control cylinders with the tension heads can occur at different time points. FIG. 9 makes evident an example with swung cylinder.

The rider rollers do not need to run through the whole swinging range between primary position and secondary position. If the paper rolls are running stably, then the rider rollers can be removed.

Figure 11:
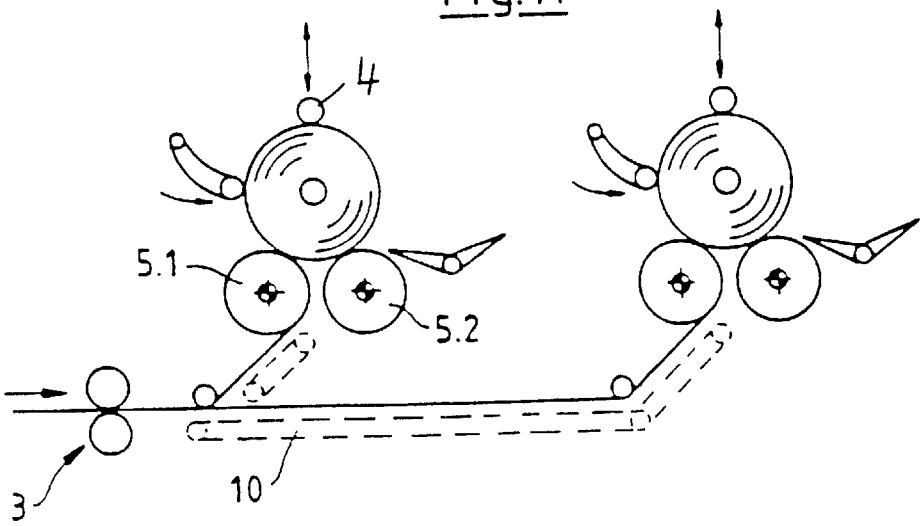
FIGS. 11–13 illustrate a third concept of the invention wherein at least two winding stations are used and each includes a pair of supporting rollers.
Figure 12:
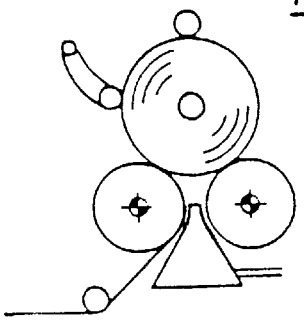
Figure 13:
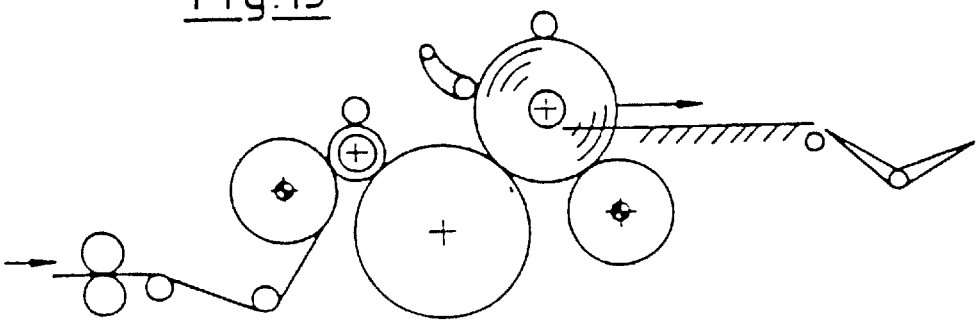

In FIGS. 11 to 13 concept III of the invention is illustrated.

Here, too, again two winding stations are provided. The feed to the individual strips cut out of the wide paper web occurs in alternation over a corresponding web transfer system 10.

Concept III operates with winding stations which have in each case two carrying rollers 5.1, 5.2.

In concept III again winding rods are provided with tubes present on them. Alternatively there can also be used stabilized individual tubes with vibration damping. It can be operated with or with out center drive.

The apparatus operates as follows.

First of all the paper web brought in from the left in the representation according to FIG. 1 is guided briefly, without use of the longitudinal cutter 3, to the first of the two winding stations. Through which it runs at operating speed, and from which it is fed to a waste pulper.

As rapidly as possible there occurs then an activating of the longitudinal cutter 3. The paper strips concerned are now again fed in alternation to the two winding stations. They enclose the winding tubes concerned. The rider roller 4 is promptly emplaced.

We claim:

1. Winding device for the taking up of a paper web with a carrying drum (1) onto which the paper web coming from a feed side is brought up, with a winding core (2), with articulated levers which have forks and which swing the paper web around the carrying drum (1) from a feed position into a pay-out position, with a lengthwise cutter (3) provided in the zone of the feed side, engaged in front of the carrying drum (1), for dividing the paper web into paper strips, with a carrying roll (5) arranged in the pay-out zone on the pay-out side of the carrying drum (1), a rider roller pair (4.1, 4.2) for applying a pressure force upon the arising paper roll (7) is provided, to the rider roller pair (4.1, 4.2) there is allocated a suspension and contact pressure device (15), the rider roller pair (4.1, 4.2) and the suspension and contact pressure device (15) are swingable around the carrying drum (1) over a certain angle, in common with the winding core (2).

2. Winding device according to claim 1, characterized in that to the winding core (2) there is allocated a drive.

3. Winding device according to claim 1, characterized in that to the carrying roller (5) there is allocated a lowering table (6).

4. Winding device according to claim 2, characterized in that to the carrying roller (5) there is allocated a lowering table (6).

5. Winding device for the taking up of a paper web immediately following its production, with a lengthwise cutter for separating the paper web into paper strips, with two winding stations, with a transfer unit for transferring the paper strips to the winding stations, in which two paper strips adjacent to one another are fed to different stations, each winding station comprises:

a carrying drum (1), a pair of tension heads to which a drive is allocated, a guide arrangement for guiding the tension head pair with the arising paper rolls (7) from a feed position around the carrying drum (1) into a pay-out position, as well as for the returning of the empty tension head pair after delivery of the finished paper rolls (7), a rider roller pair (4.1, 4.1) for applying a contact pressure force to the arising paper rolls (7) and a suspension and contact pressure device (15) are swingable around the carrying drum (1) over a certain angle, in common with the winding core (2).

6. Winding device according to claim 5, characterized in that on the pay-out side a carrying roller (5) is arranged on the carrying drum (1), in the pay-out zone.

7. Winding device according to claim 5, characterized in that on the pay-out side of the carrying drum, an outlet table (6) is provided in the pay-out zone.

8. Winding device according to claim 6, characterized in that on the pay-out side of the carrying drum, an outlet table (6) is provided in the pay-out zone.

9. Winding device for the taking up of a paper web immediately following its production, with a lengthwise cutter (3) for separating the paper web into a plurality of paper strips, with two winding stations, with a transfer unit for transferring the individual paper strips onto the winding stations, in which arrangement two paper strips adjacent to one another are fed to different stations, each winding station comprises:

two carrying rollers, a rider roller pair (4.1, 4.2) for applying a contact pressure force to the arising paper rolls (7) is provided, to the rider roller pair (4.1, 4.2) there is allocated a suspension and contact pressure device (15), the rider roller pair (4.1, 4.2) and the suspension and contact pressure device (15) are swingable around the carrying drum (1) over a certain angle, in common with the winding core (2).

10. Winding device for the taking-up of a paper web immediately following its production, with a lengthwise cutter for diving the paper web into a plurality of paper strips, with two winding stations, with a transfer unit for transferring the paper strips onto the winding stations, in which arrangement two paper strips adjacent to one another are fed to different stations, each winding station comprises:

at least two carrying rollers, a feed device for the bringing of the individual paper strips to the winding station from underneath, through the interspace between two carrying rollers adjacent to the one another, a pair of rider rollers (4.1, 4.2) is provided, to the rider roller pair (4.1, 4.2) there is allocated a suspension and contact pressure device (15), the rider roller pair (4.1, 4.2) and the suspension and contact pressure device (15) are swingable around the carrying drum (1) over a certain angle, in common with the winding core (2).

11. Winding device for the taking-up of a paper web immediately following its production, with a lengthwise cutter for separating the paper web into a plurality of paper strips, with a winding station which comprises the following elements:

a stationary or horizontally movable carrying drum (1) over which the paper web runs, a winding core (2), the winding core (2) is installable into a winding-on position situated essentially beside the carrying drum (1), between the carrying drum (1) and the paper roll arising on the winding core (2), a linear force is adjustable, the nearly full winding core (2) is transferrable into a free winding position, in which preferably a squeeze-out roller is settable on the paper roll (7), a rider roller pair (4.1, 4.2) is provided, to the rider roller pair (4.1, 4.2) there is allocated a suspension and contact pressure device (15), the rider roller pair (4.1, 4.2) and the suspension and contact pressure device (15) are swingable around the carrying drum (1) over a certain angle, in common with the winding core (2).

* * * * *